United States Patent [19]

Finsterwalder

[11] Patent Number: 4,473,915

[45] Date of Patent: Oct. 2, 1984

[54] TENSION MEMBER AND A METHOD OF ASSEMBLING AND INSTALLING THE TENSION MEMBER

[75] Inventor: Klemens Finsterwalder, Berg, Fed. Rep. of Germany

[73] Assignee: Dyckerhoff & Widmann Aktiengesellschaft, Munich, Fed. Rep. of Germany

[21] Appl. No.: 422,689

[22] Filed: Sep. 24, 1982

[30] Foreign Application Priority Data

Sep. 30, 1981 [DE] Fed. Rep. of Germany ..... 3138819

[51] Int. Cl.[3] ..... E01D 11/00

[52] U.S. Cl. ..... 14/21; 14/22; 14/18; 52/230; 52/226

[58] Field of Search ..... 14/21, 22, 23, 18, 19, 14/20, 8, 15; 52/230, 223 L, 225, 226, 83, 747

[56] References Cited

U.S. PATENT DOCUMENTS

| | | | |
|---|---|---|---|
| 2,914,783 | 12/1959 | Hoyden et al. | 14/21 |
| 3,548,432 | 12/1970 | Durkee et al. | 52/230 X |
| 3,803,785 | 4/1974 | Finsterwalder et al. | 52/230 |
| 3,866,273 | 2/1975 | Brandestini et al. | 52/223 L X |
| 3,967,421 | 7/1976 | Dufossez | 52/230 X |
| 3,975,476 | 8/1976 | Finsterwalder | 14/23 X |
| 4,192,114 | 3/1980 | Jungwirth et al. | 52/230 |
| 4,235,055 | 11/1980 | Schambeck | 52/230 |

*Primary Examiner*—Stephen J. Novosad
*Assistant Examiner*—Beverly E. Hjorth
*Attorney, Agent, or Firm*—Toren, McGeady and Stanger

[57] ABSTRACT

In an anchored tension member individual elements, such as steel rods or the like, extend between a pair of anchoring discs each of which is secured on a support. One support is spaced horizontally and vertically from the other so that the tension member extends at an acute angle to the horizontal. In assembling and installing the tension member, first one individual element is placed through a tubular casing resting on the support of a support structure which incorporates one of the supports. Next, the individual element is tensioned between and anchored to the anchoring discs. During this operation, the tubular casing is lifted off the surface and extends rectilinearly between and is spaced from both of the anchoring discs. In turn, the remaining individual elements are placed through the tubular casing, tensioned and then anchored to the anchoring discs. As a result, the tension member can be installed in position without additional auxiliary apparatus, such as lifting devices and scaffolds.

7 Claims, 19 Drawing Figures

TENSION MEMBER AND A METHOD OF ASSEMBLING AND INSTALLING THE TENSION MEMBER

SUMMARY OF THE INVENTION

The present invention is directed to a tension member and to a method of assembling and installing the tension member between a pair of supports. In its final position, the tension member is unsupported between the supports. In particular, the tension member can form a diagonal cable for a stayed girder bridge. The tension member is made up of a plurality of individual elements, such as steel rods, steel wires or steel strands, disposed in parallel relative to one another and enclosed within a tubular casing. The opposite ends of the individual elements extend out of the tubular casing and are connected into anchoring discs. One anchoring disc is incorporated into a working plane or support surface while the other anchoring disc is spaced above the support surface and horizontally from the anchoring disc in the support surface. Each of the anchoring discs contains a plurality of bores through which the ends of the individual elements extend and the individual elements are anchored between the anchoring discs so that each is individually tensioned.

In the diagonal cables of stayed girder bridges difficulty is experienced in the installation of heavy cables in the required diagonal position between anchorage locations in the roadway support and in the bridge tower which often is of considerable height. If the diagonal cables which usually consist of a number of individual elements corresponding to the required tensile force and consisting of steel rods, steel wires or steel strands, are installed on a support surface, such as the roadway surface of the completed bridge part, then they must be lifted, and supported in the required diagonal position by the lifting devices and then simultaneously mounted in the lower and upper anchoring systems. It is also possible to build an inclined scaffold for the installation of the diagonal cable and to place the individual elements in a tubular casing on the scaffold. After placement in the anchoring systems, all of the elements are simultaneously stressed.

The primary object of the present invention is to provide a method of assembling and installing such diagonal cables so that the effort involved in such assembly and installation is reduced and simplified. In addition, the invention includes an improved tension member.

In accordance with the present invention, where the tension member is made up of a number of individual elements, initially a first individual element is placed in a tubular casing resting on a support surface of a support structure. Next, the opposite ends of the individual elements are installed into the anchoring systems previously incorporated into the structure. After the first individual element is tensioned it is anchored to the anchoring systems and the tubular casing is lifted off the support surface and adopts a rectilinear configuration extending between the anchoring systems. Subsequently, the remaining individual elements are, in turn, placed through the tubular casing, tensioned and then removed.

In a preferred assembly arrangement, the individual elements are placed in a sequence based on their relative elevation with the first individual element being located at the highest position within the tension member.

For the insertion of the individual elements into the anchoring systems, assembly windows are provided between the tubular casing and the anchoring systems and, after the assembling and installing operation is completed, the assembly windows are closed.

The basic concept of the invention involves placing the tubular casing of the diagonal cable into the required inclined position between the anchoring systems by using a guide wire initially located on the support surface. After the guide wire is placed through the tubular casing and stressed between the anchoring systems, the tubular casing is lifted into the desired position. In a preferred arrangement, the guide wire can be one of the individual elements making up the tension member which after it is tensioned is immediately anchored. It is also possible, however, to use an additional wire which can be removed after at least one of the individual elements is secured in position. With the tubular casing in the required inclined position, the individual elements can be inserted one after the other through the tubular casing and then tensioned and anchored in the anchoring systems.

An important feature of the present invention is the ability to place the individual elements through the tubular casing and to place the opposite ends of the elements into the anchoring systems where the individual elements can be tensioned and then anchored. In particular, anchoring discs can be used in the anchoring systems with the discs containing openings or bores for receiving and holding the individual elements. Between the tubular casing and the anchoring systems tubular sheaths embedded in cement and axially aligned with the bores in the anchoring discs afford guidance for the individual elements during the assembly and installation operation.

Costs for assembling and installing such diagonal cables are significantly reduced by the present invention, because the diagonal cables can be simultaneously assembled and installed in the final position without the need for auxiliary means, such as lifting devices, scaffolds or the like.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIGS. 12*a* and 12*b* to 15*a* and 15*b* each show cross-sections through the anchoring system or through the tubular casing in its unsupported region during the additional steps of the assembly and installation of the individual elements.

DETAIL DESCRIPTION OF THE INVENTION

Figure 1:
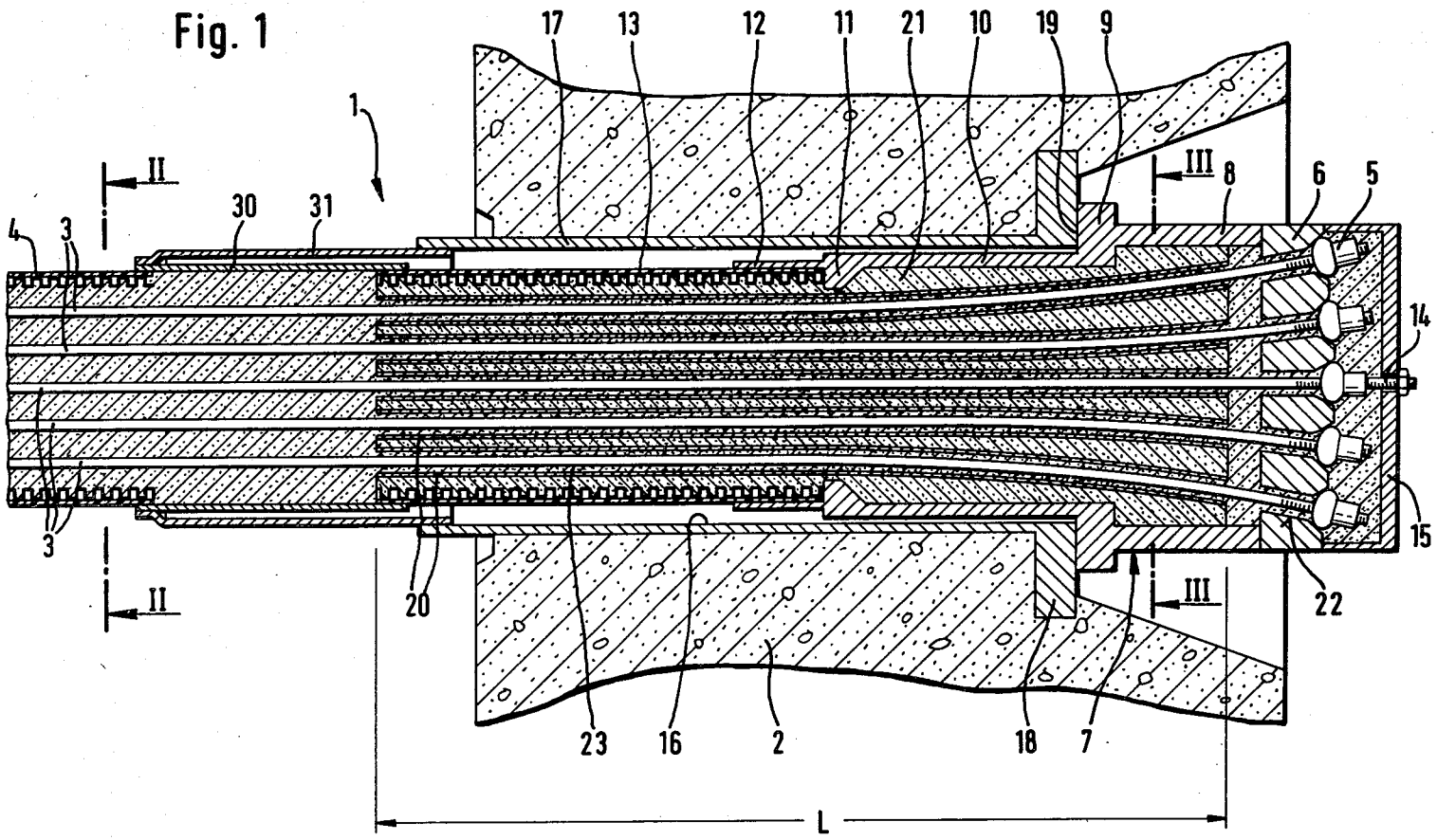
FIG. 1 is an axially extending section through the anchoring region of a tension member embodying the present invention.
Figure 11:
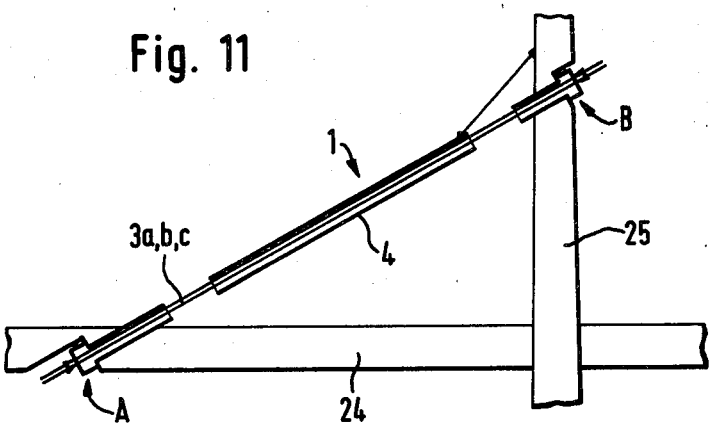
FIG. 11 is a schematic illustration of a further step in the assembly and installation of the tension member.
Figure 12A:
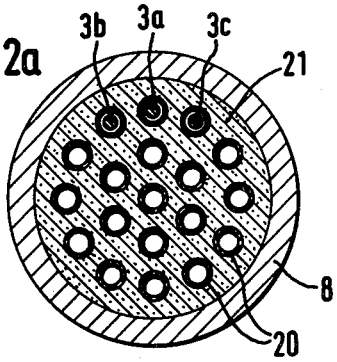
Figure 12B:
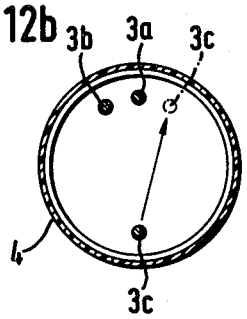
Figure 13A:
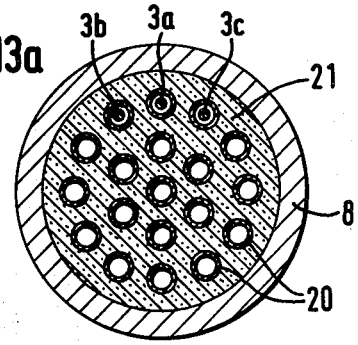
Figure 13B:
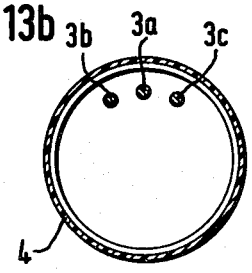
Figure 14A:
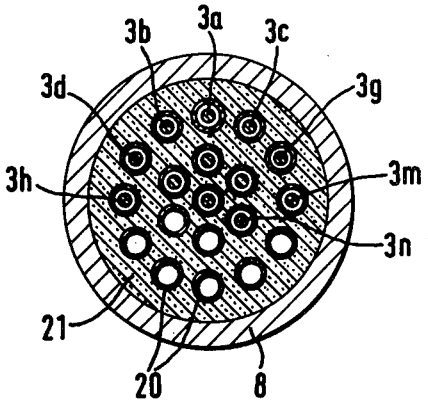
Figure 14B:
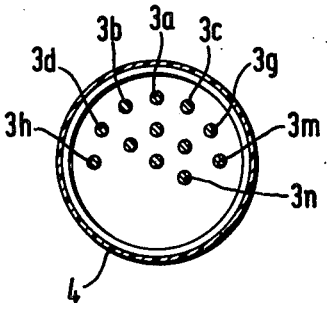

In FIG. 1 a tension member 1 is anchored in a concrete structural part 2, such as the roadway support or tower of a stayed girder bridge. In FIG. 11 there is a schematic illustration of the tension member 1 extending between the anchoring systems in a structural member. The diagonal cable or tension member 1 is stretched rectilinearly between an anchoring system A in a roadway support 24 and another anchoring system B in a vertically extending tower 25. Generally speaking, the roadway surface 24 extends horizontally while the tower 25 extends upwardly or vertically. The two anchoring systems A and B are basically of the same construction. The anchoring systems illustrated in FIG. 1 represent one of a number of possible embodiments.

As illustrated in FIG. 1, the tension member 1 is made up of a number of individual elements 3 corresponding to the tension stress to be applied. The individual elements 3 may be steel rods, steel wires or steel strands extending unsupported between the anchoring systems A and B within a tubular casing 4 formed, for instance of a plastics material. In the illustrated embodiment the individual elements 3 are steel rods or steel wires. Such individual elements 3 are provided with threads at least at their ends and they are secured by anchoring nuts 4 each to an anchoring disc 6 of the anchoring system.

Figure 2:
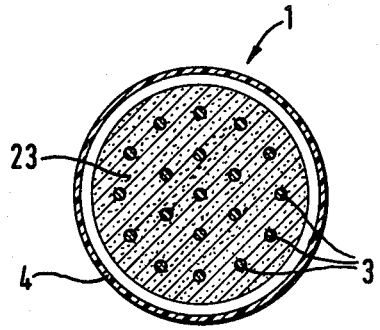
FIG. 2 is a cross-sectional view through the unsupported region of the tension member taken along the line II—II in FIG. 1.
Figure 3:
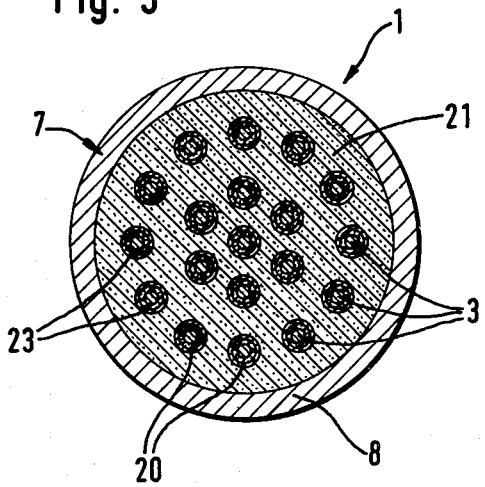
FIG. 3 is a cross-sectional view through the tension member in the anchoring region taken along the line III—III in FIG. 1.

As can be seen in FIGS. 2 and 3, the tension member 1 is made up of a total of 19 individual elements 3. The individual elements are arranged within the tension member in two concentric circles spaced apart with a single element located at the center. The number of individual elements may be chosen as desired, depending on the load to be supported.

As shown in FIG. 1, anchoring disc 6 is supported against the outer end of an axially extending pipe 7. The anchoring pipe 7 has a larger diameter section 8 adjacent the anchoring disc 6 with an annular flange 9 separating the larger diameter section from an axially extending smaller diameter section 10. The wall thickness of the smaller diameter section 10 is less than that of the larger diameter section 8. At its end more remote from the anchoring disc 6, the smaller diameter section 10 has a radially inwardly extending flange 11 of increased thickness with an axial extension 12 projecting from the flange 11 away from the anchoring disc 6. The extension 12 has a reduced outside diameter compared to the section 10 and it serves as a connection for a tubular sheath 13 which is inserted into the extension 12.

In FIG. 1 the tension member is shown in the final anchored state with anchoring nut 5 threaded onto the ends of the individual elements 3 projecting through the anchoring disc 6. The outwardly projecting ends of the individual elements 3 are protected by a cover 15 secured against the outwardly facing side of the anchoring disc 6 by a nut 14 secured on an elongated individual element extending through the cover.

Within the concrete structural part 2, the tension member 1 extends through a duct 16 formed by a steel pipe 17. The steel pipe 17 is in direct contact with the concrete structural part. At its end closer to the anchoring disc 6, the duct 16 has a radially outwardly extending flange-like abutment plate 18. Abutment plate 18 bears against the flange 9 on the anchoring pipe 7 and is supported via a support surface 19. The entire tensile force developed in the tension member 1 is applied to the concrete structural part 2 via support surface 19.

In the region extending through the structural part 2 for the length L, note FIG. 1, each individual element 3 is positioned within an individual tubular sheath 20 and the position of the tubular sheaths 20 within the tubular sheath 13 and the anchoring pipe 7 is fixed by a primary injection of cement grout 21. The axis of each tubular sheath 20 is aligned with the axis of an individual bore 22 through the anchoring disc 6. As a result, each of the individual elements 3, as it is pushed through one of the tubular sheaths 20, is aligned with the corresponding bore 22 in the anchoring disc 6.

After the individual elements 3 are tensioned and anchored, the remaining open spaces between the individual elements 3 and the tubular casing 4 and between the individual elements 3 and the tubular sheaths 20 are filled with cement grout 23 during a second grouting operation, note FIGS. 2 and 3. When the tension member is completed, all of the individual elements 3 are closely embedded in cement grout which affords corrosion protection and effects a composite action between the individual elements 3 and the anchoring pipe 7.

In the anchoring region L of the embodiment illustrated in FIG. 1, the quiescent loads from the dead weight in the area of the so-called active final anchoring are applied by means of the anchoring disc 6. The load application occurs during tensioning of the individual elements 3. In the region of the anchoring pipe 7 there is a distance of passive self-anchoring in which, after the cement grout 21, 23 hardens following the primary and secondary grouting operations, the live loads which occur in addition to the quiescent loads, are transferred directly by means of composite action to the anchoring pipe 7 without impairing the final anchoring at the anchoring disc 6. The radially inwardly directed flange 11 serves to introduce the shearing forces which occur along the anchoring pipe 7 into the anchoring pipe.

With the aid of FIGS. 4 to 15 the following is a description of the manner in which a tension member 1 of the above type, which can be used as a diagonal cable, is at the same time assembled and installed.

Figure 5:
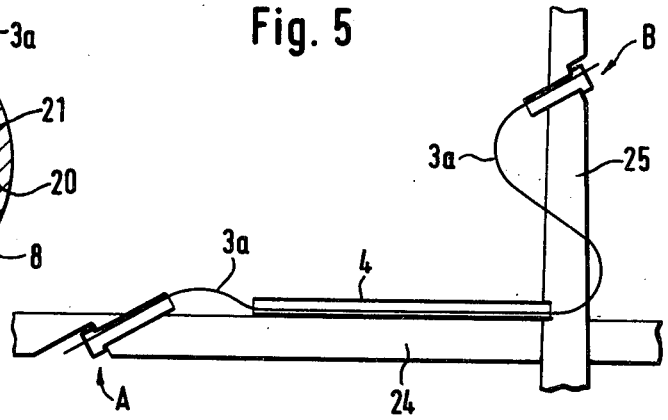
FIG. 5 is a schematic illustration of the assembling and installing operation of an individual element of the tension member.
Figure 7:
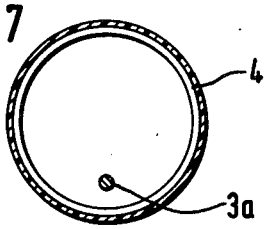
FIG. 7 is a cross-sectional view through the tubular casing shown in FIG. 5.

In FIG. 5 the initial step in the assembly and installation of the tension member as a diagonal cable is shown schematically. Anchoring region A is provided in the generally horizontal roadway support 24 and anchoring region B is located in the upwardly extending tower 25. The anchoring regions A and B are constructed in the manner shown in FIG. 1 that is, in the concrete structural part 2 of the roadway support 24 or the tower 25.

In each anchoring region the duct 16 is positioned, formed of a metal pipe 17, and embedded in the concrete with the abutment plate 18 extending radially outwardly into and secured within the concrete. In addition, an anchoring pipe 7 is inserted into the anchoring disc end of the duct 16. The axially extending tubular sheaths 20 are fixed within the anchoring pipe 7 by the primary injection of grout 21 and the sheaths function as open passageways. As can be seen in FIG. 1 within the axial extent of the anchoring pipe 7 the individual elements 3 are spread outwardly as they approach the anchoring disc 6 so that the spacing between the individual elements increases as compared to the spacing within the tubular casing 4 and the tubular sheath 13. Within the anchoring pipe 7 the tubular sheaths 20 are in axial alignment with the bores 22 through the anchoring disc 6.

At the commencement of the assembling and installing operation, the tubular casing 4 is placed on the roadway support 24. Subsequently, a first individual element 3*a* is inserted into the anchoring region A into the position shown in the upper or crown region of FIGS. 4 and 5. The first individual element 3*a* is then pushed through the tubular casing 4 and is finally mounted in the anchoring region B in the tower 25 so that it assumes the position shown in FIGS. 4 and 6. The individual element 3*a* is located within the tubular casing 4 in the position shown in FIG. 7. In place of the individual element 3*a*, a guide wire could be inserted and subsequently be replaced by the individual element 3*a*.

Figure 8:
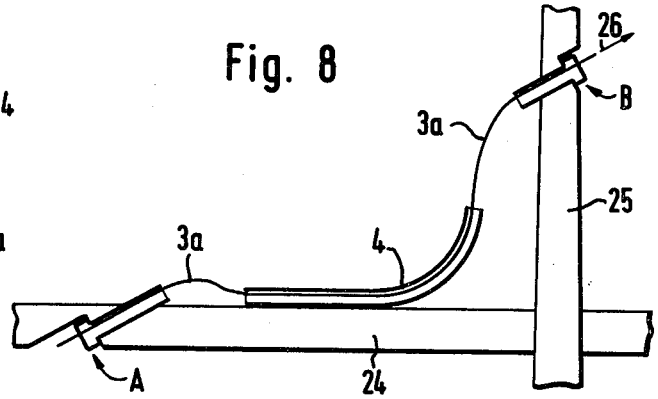
FIG. 8 is a schematic illustration of the outset of the tensioning of the individual element shown in FIG. 5.
Figure 9:
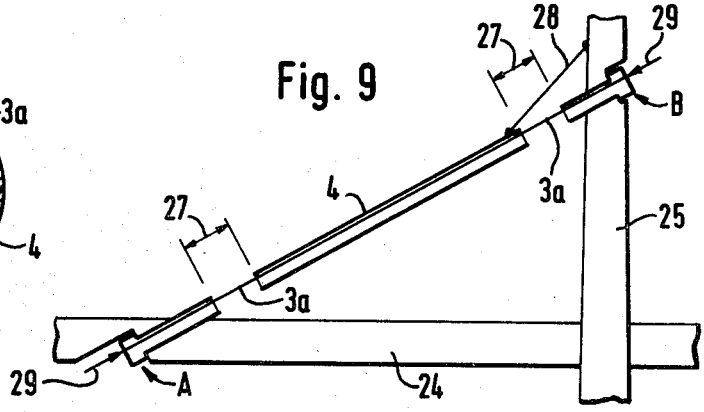
FIG. 9 is a schematic illustration of the individual element and the tubular casing of FIGS. 5 and 8, but shown in the tensioned condition.

According to FIG. 8 the individual element 3*a* is tensioned at the anchoring region B in the direction of the arrow 26. During this tensioning operation, the tubular casing 4 which has a certain amount of flexibility, slowly straightens out and assumes a rectilinear diagonal position as shown in FIG. 9. The first individual element 3*a* is finally anchored in the anchoring regions A and B relative to the respective anchoring discs 6 so that the tensioning force, as indicated by the arrows 29, is transferred into the support structure.

Figure 10:
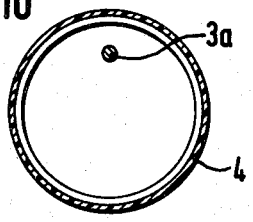
FIG. 10 is a cross-section through the tubular casing illustrated in FIG. 9.

Due to its dead weight, the tubular casing 4 hangs on the individual element 3*a* and assumes the position shown in FIG. 10. As shown in FIG. 1, tubular casing 4 is somewhat shorter than the total length between the anchoring regions A and B so that each of its opposite ends an assembly window 27 is provided in the space between the tubular casing and the tubular sheath 13. The assembly windows 27 serve, as can be appreciated in FIG. 4, to facilitate the manipulation of the individual elements 3, since they pass out of the tubular sheath 4 in no particular order and must be inserted into a selected duct in the anchoring region. To maintain the tubular casing 4 in position, a rigging 28 is provided at the tower 25, note FIGS. 9 and 11.

The installation sequence of the remaining individual elements 3*b*, 3*c* and so on is shown in FIGS. 12*a* to 15*b* where FIGS. 12*a*, 13*a*, 14*a* and 15*a* illustrate the arrangement within the anchoring regions A and B in which the individual elements 3 are exactly arranged inside the tubular sheaths 20. FIGS. 12*b*, 13*b*, 14*b*, and 15*b* each show the arrangement of the individual elements 3 within the tubular sheath 4, that is the position assumed by the individual elements after the tensioning and anchoring steps are completed.

Figure 4:
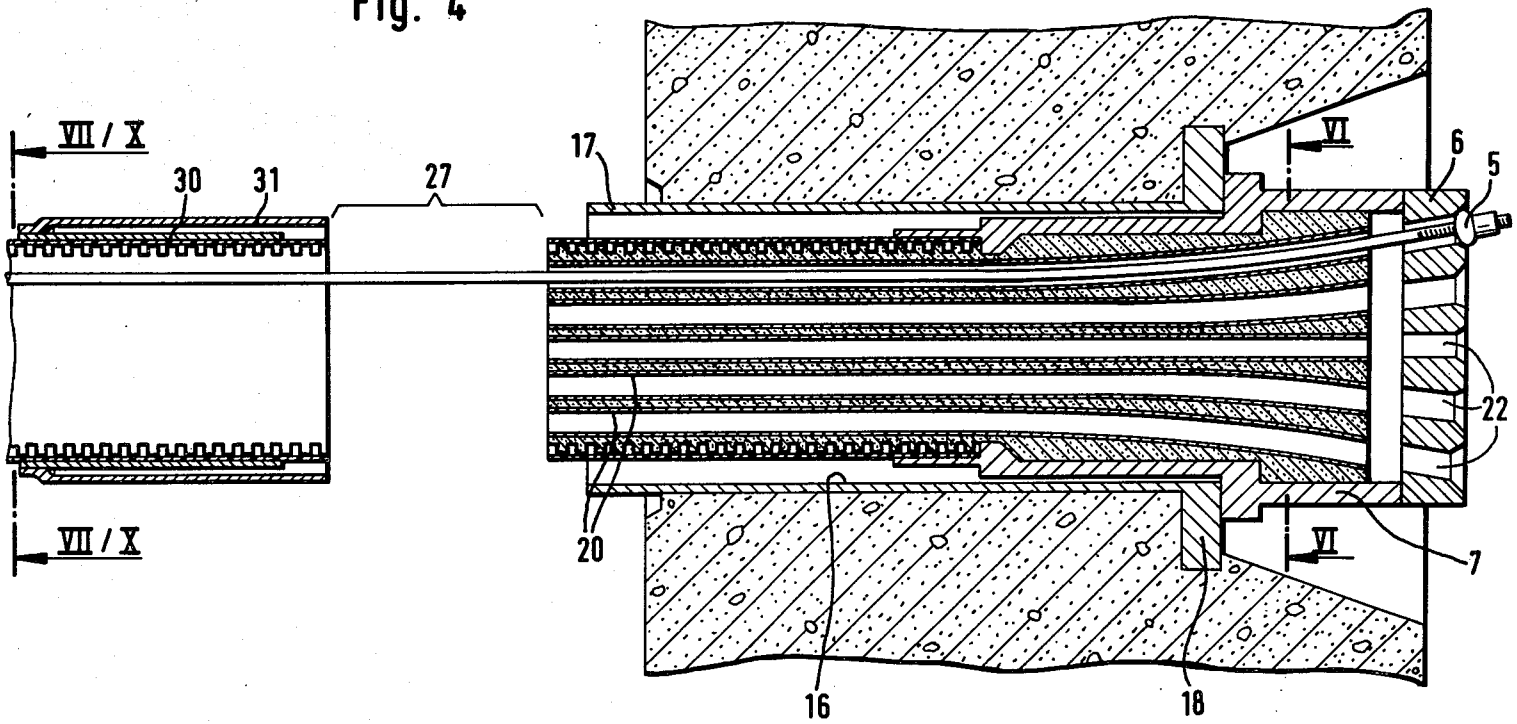
FIG. 4 is an axially extending section through the anchoring region of the tension member at the outset of the assembling and installing operation.
Figure 6:
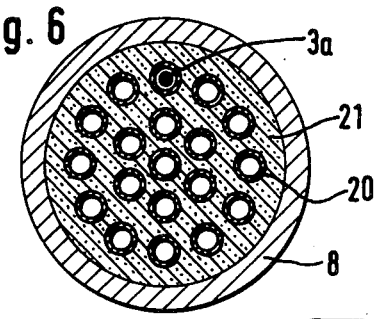
FIG. 6 is a cross-sectional view through the tension member in the anchoring areas A and B.
Figure 15A:
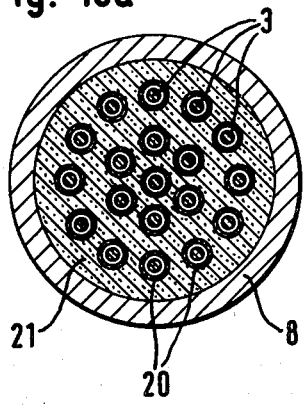
Figure 15B:
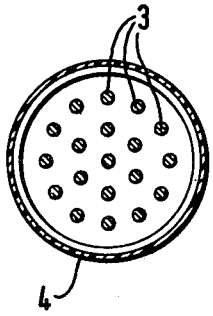

After all of the individual elements 3 are installed, note FIGS. 15*a* and 15*b*, the assembly windows 27 are closed by sliding an inner tubular member 28, previously set back as shown in FIG. 4, over the windows and the secondary injection of the grout 23 is effected filling the hollow space between the individual elements 3 and the tubular casing 4 and the openings between the individual elements 3 and the tubular sheaths 20, note FIG. 1. An outer pipe member 29, preferably of steel, creates a bending-resistant support in the region where the tension member 1 enters into the structural part 2.

While specific embodiments of the invention have been shown and described in detail to illustrate the application of the inventive principles, it will be understood that the invention may be embodied otherwise without departing from such principles.

I claim:

1. Method of assembling and installing a tension member unsupported between its ends, such as a diagonal cable for a stayed girder bridge, the tension member is made up of a plurality of parallel individual elements such as steel rods, steel wires or steel strands arranged within a tubular casing, an anchoring system for each end of the tension member including an anchoring disc having bores therethrough for the individual elements, means for anchoring the individual elements to each anchoring disc so that the individual elements are tensioned between the anchoring discs, one anchoring system located in a generally horizontally extending first support and the other anchoring system located in an upwardly extending second support spaced upwardly and laterally from the first support, comprising the steps of providing an axially elongated tubular passageway in each anchoring system extending through the associated one of the first or second support with the tubular passageway having a first end adjacent the anchoring disc in the respective anchoring system and a second end spaced more remotely from the anchoring disc of the respective anchoring system, providing an elongated sheath in each tubular passageway for each of the individual elements and aligning each sheath with a different one of the bores in the anchoring disc, placing a tubular casing on the first support between the anchoring systems with the tubular casing having a length less than the spacing between the second ends of the tubular passageway in the first and second supports, inserting a first individual element through the tubular casing and guiding one end of the element through one of the sheaths in the tubular passageway in one of the first and second supports into the aligned bore in the anchoring disc and guiding the other end of the element through one of the sheaths in the tubular passageway in the other one of the first and second supports into the aligned bore in the anchoring discs, tensioning the first individual element between the anchoring discs in the anchoring systems and anchoring the first individual element at the anchoring discs so that the tubular casing is lifted upwardly off the first support and extends rectilinearly between the anchoring systems in the first and second supports, and supporting the tubular casing at least in part on the first individual element, in turn, inserting each of the remaining individual elements in the same manner through the tubular casing and the sheaths in the tubular passageways into the anchoring discs, and tensioning each remaining element and anchoring each remaining element after it is tensioned.

2. Method, as set forth in claim 1, including the step of placing the individual elements in the sequence of their elevation with the individual element located uppermost in the anchoring system of the second support being installed first and the lowermost individual element being installed last.

3. Method, as set forth in claim 1 or 2, including the step of providing an assembly window between the end of the tubular casing and the tubular passageway in the adjacent anchoring system for guiding the individual elements into sheaths with the tubular passageway in the anchoring system, and closing the assembly windows after the completion of the assembly and installation of all of the individual elements into the anchoring systems.

4. Method, as set forth in claim 1 or 2, including temporarily supporting the tubular casing after it is lifted off the support surface on the second support.

5. Method, as set forth in claim 1 or 2, including the step of grouting open spaces within the tubular casing and the anchoring system after the completion of the assembly and installation of all of the individual elements.

6. Method, as set forth in claim 1, including grouting the sheaths in the tubular passageways prior to passing the individual elements through the sheaths into the anchoring discs.

7. Method, as set forth in claim 1, including increasing the spacing between the sheaths in each tubular passageway from the second end of the tubular passageway toward the first end thereof.

* * * * *